United States Patent [19]

Massa

[11] Patent Number: 4,660,186

[45] Date of Patent: Apr. 21, 1987

[54] ELECTROMAGNETIC TRANSDUCERS FOR UNDERWATER LOW-FREQUENCY HIGH-POWER USE

[75] Inventor: Frank Massa, 280 Lincoln St., Hingham, Mass. 02043

[73] Assignees: Fred M. Dellorfano, Jr.; Donald P. Massa, both of Cohasset, Mass. ; Trustees of The Stoneleigh Trust u/d/t

[21] Appl. No.: 832,313

[22] Filed: Feb. 24, 1986

[51] Int. Cl.[4] ..... H04R 13/00

[52] U.S. Cl. ..... 367/142; 367/175

[58] Field of Search ..... 367/174, 175, 182, 142; 179/115.5 BS, 115.5 E, 115.5 R; 73/667; 324/236, 224

[56] References Cited

U.S. PATENT DOCUMENTS

| | | | |
|---|---|---|---|
| 1,321,197 | 11/1919 | Fay | 367/175 |
| 1,526,414 | 2/1925 | Bois-Reymond | 367/174 |
| 1,677,945 | 7/1928 | Williams | 367/142 |
| 3,993,973 | 11/1976 | Hutchins et al. | 367/174 |
| 4,090,041 | 5/1978 | Mori et al. | 179/115 R |

*Primary Examiner*—Charles T. Jordan
*Assistant Examiner*—John W. Eldred

[57] ABSTRACT

An electromagnetically driven vibratile piston underwater transducer element generates acoustic intensity levels in the order of 50 peak Watts per square inch of radiating surface in the low audible frequency region in the vicinity of 1 kHz. The design achieves an efficiency greater than 50% and a very low Q of less than 2. The air gap is designed to seat mechanically if the unit is operated accidentally at high-power levels while acoustically unloaded thereby protecting the spring assembly from unsafe amplitudes of vibration. The mechanical protective design also serves to protect the transducer vibrating structure from failure if the transducer is exposed to the proximity of an underwater explosive shock wave. The transducer construction results in a minimum overall length so that when the transducer element is mounted in a planar array attached to the hull of a vessel the projection of the radiating surface of the array from the surface of the hull is minimized.

18 Claims, 2 Drawing Figures

ELECTROMAGNETIC TRANSDUCERS FOR UNDERWATER LOW-FREQUENCY HIGH-POWER USE

This invention is concerned with improvements in the design of underwater electromagnetic transducers to permit the efficient generation of high intensity underwater sound in the frequency region below approximately 3 kHz. During World War II, underwater transducers for sonar applications were generally limited to the frequency regions above approximately 10 kHz because of the impossibility of obtaining large amplitudes of vibration from piezoelectric crystal plates because of the limitation in the size of crystals that could be produced. The lowest practical operating frequency of the early scanning sonar transducers developed by this Applicant during World War II which made use of the newly available Amonium Di-hydrogen Phosphate crystals as the transduction material was in the vicinity of 15 kHz.

With increased engineering activity in sonar fundamentals during and after World War II, it became recognized that the increased attenuation of sound through the ocean at the higher audible frequencies imposed a serious limitation on the range of detection of underwater targets. During the decade of the 1960's, scanning sonar transducers were developed utilizing piezoelectric ceramic elements which permitted the progressive reduction of the operating frequency from the 15 kHz region to the 3 or 4 kHz region. For the further reduction of the operating frequency of sonar transducers down to the region in the vicinity of 1 kHz, the length of the ceramic stack necessary to drive the vibratile piston to peak amplitudes of a few thousandths of an inch would have to be one or two feet in length which results in a fragile and awkward transducer element design which is structurally unreliable for fleet operation.

The primary object of this invention is to design an electromagnetic transducer capable of efficiently generating high intensity sound pressure levels underwater in the mid-audible frequency region within the approximate range 500 Hz to 2500 Hz.

Another object of this invention is to reduce the rear radiation of sound from the proposed electromagnetic transducer by more than 10 dB.

A further object of this invention is to reduce the overall length of the electromagnetic low-frequency transducer element assembly so that when the transducer element is used in a planar array attached to the hull of a vessel the projection of the radiating surface of the array from the surface of the hull is minimized.

A still further object of the invention is to design an efficient high-power electromagnetic transducer element which is extremely rugged and withstands the proximity of underwater explosive blast pressures without damage.

These and other objects of the invention will become evident in the following detailed description. The novel features which are characteristic of the invention are set forth with particularity in the appended claims. The invention itself, however, both as to its organization and method of operation, as well as advantages thereof will best be understood from the following description when read in connection with the accompanying drawings, in which:

Figure 2:
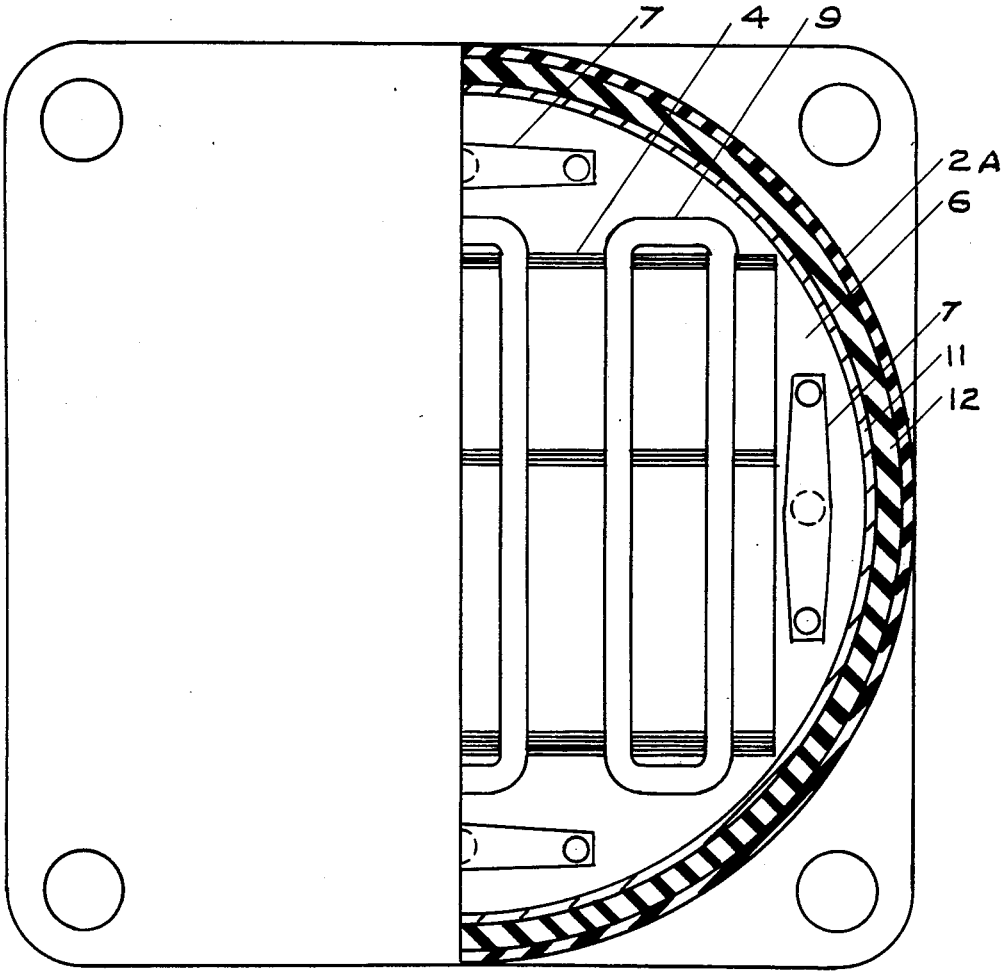
FIG. 2 is a partial cut-away plan view of the structure.
Figure 1:
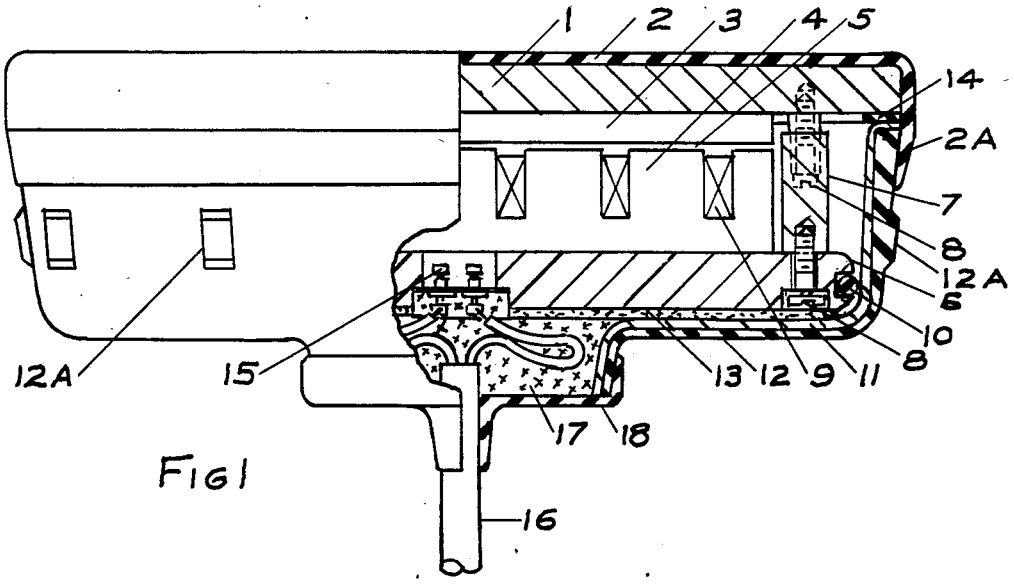
FIG. 1 is a partial vertical cross-sectional cut-away view illustrating one preferred form of construction of the inventive electromagnetic transducer.

Referring to the figures, the reference character 1 represents a vibratile plate such as an aluminum piston on whose outer surface is molded an elastomer waterproof cap 2 as shown illustrated in FIG. 1. Although the vibratile piston 1 is illustrated in the drawings as a circular disc, it could be of any other shape such as square or hexagonal. A stack of I-shaped laminations 3 is bonded to the inner plane surface of the piston 1 using a suitable metal bonding agent well known in the art such as epoxy. The free unbonded inner plane surface of the lamination stack 3 is accurately spaced from the unbonded free plane surface of the E-shaped lamination stack 4 to form a uniform air gap 5. The flat base surface of the E-shaped lamination stack 4 is securely bonded to the flat mating surface of the massive inertial base member 6 as illustrated in FIG. 1. A suitable cement well known in the art such as epoxy is used to bond the mating surfaces. The magnitude of the air gap is determined by the precise ground height of the spring members 7 which are fastened by the bolts 8 to the facing parallel plane surfaces of the piston 1 and inertial base member 6. The required stiffness of the springs 7 is determined by the desired frequency range of operation of the vibratile piston 1. Rectangular-shaped coils of insulated copper wire 9 are placed in each pair of slots provided in the E lamination stack assembly 4 as illustrated. The coils are potted securely within the slots with any suitable potting compound well known in the art, such as epoxy, to insure that the coils become a rigid part of the electromagnetic assembly.

The remainder of the transducer assembly is illustrated in the partial cross-sectional view of FIG. 1. An O-ring 10 is fitted into the periphery of the massive inertial base member 6 in order to insure the concentric location of the housing structure 11, when it is assembled as a rear cover to seal the inner electromagnetic portion of the transducer assembly. The metal housing 11 is preferably covered with a molded elastomer 12 such as neoprene. Tapered wedges 12A are molded around the periphery of the neoprene covering 12 as illustrated to serve as shock mounts when the transducer is mounted into an array frame. The tapered rubber wedges 12A will provide an interference fit between the rubber covered transducer housing and the hole diameter provided in the mounting frame structure to locate the transducer. The interference fit of the tapered rubber shock mounts will also provide mechanical damping for the array frame and thus prevent ringing of the frame structure when high-power acoustic signals are transmitted from the transducer elements during operation. An isolation gasket 13 of a material such as corprene is cemented to the base of the inertial base member 6 and the thickness is chosen such that it makes approximate contact with the inner rear surface of the housing 11. The isolation gasket will provide additional damping and also limit the displacement of the magnetic structure when the transducer is subjected to an explosive underwater shock.

A peripheral rubber gasket 14 which may be a separate rubber washer, or it can be an integral part of the inner surface of the molded rubber cap structure 2 or an integral part of the molded elastomer covering 12 bonded to the metal housing 11, is cemented with a suitable rubber-to-metal cement well known in the art between the open peripheral flanged end of the housing 11 and the inner peripheral plane surface of the piston 1. The thickness of the rubber gasket 14 is chosen such that the compliance of the gasket in combination with the mass of the housing 11 resonates at a frequency below the operating frequency of the transducer and preferably approximately an octave or more below the operating frequency of the transducer. This will insure that the rear housing will become effectively uncoupled from the vibrating piston during the operation of the transducer thereby preventing the transducer housing 11 from radiating undesireable amounts of acoustic energy and thereby prevent the transducer from behaving as a di-pole over its operating frequency range.

The elastomer rubber cap 2 which is molded to the radiating surface of the piston 1 is provided with an overhanging cylindrical skirt portion 2A which at final assembly is stretched over the periphery of the rubber covering 12 which is molded over the outer surface of the housing member 11. Before stretching the skirt portion 2A over the mating rubber surface 12 the mating surfaces are preferably coated with a suitable waterproof rubber cement, as is well known in the art, to insure a permanent waterproof seal at the overlapping joint.

The electrical coils 9 may be connected in series or parallel as desired to best suit the impedance requirement of the transducer assembly. The electrical connections to the coils 9 are brought out through insulated terminals 15 fitted into the recessed opening provided in the inertial mass member 6 as illustrated in FIG. 1. The conductors from an external waterproof cable 16 are soldered or otherwise suitably connected to the terminals 15 and the terminal compartment is sealed with a suitable potting compound 17. After potting, the rubber cap 18 is stretched over the molded rubber surface 12 of the housing structure as shown in FIG. 1. Rubber cement is applied between the mating rubber surfaces in the same manner as described for sealing the rubber skirt portion 2A to the outer periphery of rubber covering 12.

Having described the basic elements of the electromechanical vibrating system employed in the inventive underwater transducer, more detailed discussion will be presented to show the specific relationships that must be established between the various components of the electromechanical vibrating system in order to realize the difficult basic objectives of this invention which include:

1. High-efficiency high-power operation in the mid-audible frequency region defined as approximately 500 to 2500 Hz;

2. Acoustic power densities in excess of 25 Watts peak per square inch of the vibratile piston surface;

3. Broadband operation with a Q factor less than 2 when an array of the described transducer elements are 100% rho-c loaded;

4. Reduce rear radiation from the transducer element by more than 10 dB below the front radiation from the vibratile piston surface;

5. Rugged construction sufficient to resist high intensity underwater explosive shock pressures without damage.

One of the important design parameters necessary to meet the objectives set forth above for the inventive transducer is to provide very high air-gap flux density in the design. It is not self-evident nor is it generally recognized how extremely large a power output gain can be actually realized in an electromagnetic transducer for relatively small increases in air-gap flux density. A simple example will illustrate the surprising gain in acoustic power output. Assume a relatively small increase of 10% in air-gap flux density; then the increase in magnetic force generated in the air gap to drive the piston, which is proportioned to the square of the flux density, will be $(1.1)^2-(1.0)^2=21\%$, which will result in an increase in the amplitude of vibration of the vibratile piston 1 by 21%. Since the acoustic power radiated from the vibratile piston will increase by the square of the amplitude, the surprising increase in acoustic power will be $(1.21)^2-(1.0)^2=46.4\%$. For a 20% increase in flux density the acoustic power output from the transducer will more than double. This enormous power gain of more than 100% for a relatively small increase in air-gap flux density of 20% is a surprising conclusion which is not self-evident without making a detailed analysis.

The best grades of silicon steel available for use in making transformer laminations are limited to maximum flux densities in the neighborhood of 18,000 gausses above which the magnetic permiability of the silicon steel drops rapidly and magnetic saturation occurs which makes it undesirable to use the material at higher flux densities. Applicant has found that magnetic laminations made of Vanadium Permendur, which is an alloy of 2% Vanadium, 49% Cobalt and 49% Iron has a higher magnetic saturation limit than silicon steel which makes it possible to increase the maximum air-gap flux density by approximately 20%, from 18,000 gausses to 21,500 gausses, and thereby double the acoustic power output of the inventive transducer. Experimental data obtained by Applicant indicates that with the use of Vanadium Permendur laminations for the magnetic circuit and corresponding air-gap flux densities in the vicinity of 20,000 gausses or more it is possible to achieve peak acoustic power densities from the vibrating piston in the order of 50 Watts/sq. in. With silicon steel and an air-gap flux density limite 18,000 gausses, the peak acoustic power densities from the vibratile piston will be reduced to the order of 25 Watts/sq. in. In view of the very high cost of Permendur compared to silicon steel the use of Permendur will not be economical unless the enormous increase in acoustic power output achieved by the Permendur transducer design is of prime necessity for the transducer application.

In order to minimize the amplitude of vibration of the inertial base member 6 and thereby reduce the rear radiation from the internal spring-suspended portion of the electromagnetic vibrating structure, the total weight of the rear inertial base portion of the vibrating structure, which is made up of the E lamination stack 4, the coils 9 and the base member 6, should be much greater than the total weight of the front vibratile plate portion of the assembly. To achieve a reduction in amplitude of the rear inertial structure by at least 10 dB, the total weight of the rear inertial structure should be at least three times the weight of the total vibratile piston portion of the vibrating assembly. To achieve a preferable 15 dB reduction in amplitude of the inertial structure the total rear inertial portion of the vibrating structure should be at least five times the weight of the vibratile piston portion.

In order to achieve a very high degree of ruggedness and reliability for the proposed transducer construction the air-gap dimension is chosen so that at accidental abnormal increased amplitudes of operation, such as might occur during high cavitation when the transducer is accidentally operated at full power in very shallow water or during removal of the transducer out of the water, air-gap closure will occur to limit the abnormal increased amplitude of vibration to a maximum safe level which is below the fatigue limit of the springs 7 used for the compliance element in the electromechanical vibrating assembly portion of the transducer. Air-gap closure will also take place if the transducer is exposed to the proximity of intense underwater explosive shock pressures which will prevent permanent damage to the spring suspension system used in the design.

While a few specific embodiments of the present invention have been shown and described, it should be understood that various additional modifications and alternative constructions may be made without departing from the true spirit and scope of the invention. Therefore, the appended claims are intended to cover all such equivalent alternative constructions that fall within their true spirit and scope as listed in the following claims.

I claim:

1. In combination in an electromagnetic transducer assembly designed for efficient underwater generation of high power acoustic energy densities in excess of approximately 25 peak Watts per square inch of radiating surface when operating at a mid-audible frequency located within the approximate range 500 Hz to 2500 Hz under conditions of 100% rho-c loading, a vibratile plate having an outer surface adapted for transmitting oscillatory mechanical vibrations into the water when the transducer is immersed therdin, said vibratile plate also having a flat inner plane surface, a first magnetic flux conducting structure having a specified thickness defined by two parallel plane surfaces, means for rigidly attaching the first one of said two parallel surfaces of said first magnetic flux conducting structure to the said flat inner plane surface of said vibratile plate, a massive inertial base member characterized in that it has at least one flat plane surface, and also characterized in that the area of said flat plane surface is comparable to the area of said vibratile plate, a second magnetic flux conducting structure having a specified thickness defined by two parallel plane surfaces, means for rigidly attaching the first one of said two parallel surfaces of said second magnetic flux conducting structure to the said flat plane surface of said massive inertial base member, said second parallel surface of said second magnetic flux conducting structure characterized in that a plurality of pairs of slots are provided into the said second parallel plane surface of said second magnetic flux conducting structure, a plurality of coils wound with insulated electrical conductors and dimensioned to fit with adequate clearance within said plurality of pairs of slots provided into the said second parallel plane surface of said second magnetic flux conducting structure, rigid potting means filling said clearance space between said coils and said slots, a plurality of spring members characterized in that their overall length dimensions are precisely machined to a uniform specified height, first fastening means for attaching one end of said spring members to the peripheral area of said inner plane surface of said vibratile plate, second fastening means for attaching the opposite end of said spring members to the peripheral area of said flat plane surface of said massive inertial base member, the uniform specified height of said plurality of spring members and the precise location of the springs on the facing peripheral flat surfaces of said vibratile plate and said inertial base member establish a specified uniform air-gap dimension between said first and said second magnetic flux conducting structure, a waterproof housing structure for enclosing said electromagnetic transducer assembly, sealed insulated terminal means associated with said housing structure for establishing external electrical connection through the transducer housing to said enclosed electromagnetic transducer assembly, electrical connection means from said plurality of coils to said terminal means, and means for generating controlled electromagnetic forces in the magnetic air gap by supplying controlled electrical power to said electrical terminal means.

2. The invention in claim 1 characterized in that said supplied electrical power includes a dc component of current for establishing a fixed flux density in said air gap and an ac component of current for modulating said fixed flux density at the frequency corresponding to the frequency of said ac component of current whereby corresponding ac magnetic forces are generated in the air gap and are transferred to said vibratile plate.

3. The invention in claim 1 characterized in that at least a portion of said magnetic flux conducting structures include laminations made of a magnetic alloy containing approximately 49% Cobalt, 49% Iron and 2% Vanadium.

4. The invention in claim 3 further characterized in that the peak flux density in the air gap at maximum full-power operation of the transducer is in the vicinity of 20,000 gausses.

5. The invention in claim 1 characterized in that said first magnetic flux conducting structure comprises an assembly of laminations made of a magnetic alloy containing approximately 49% Cobalt, 49% Iron and 2% Vanadium.

6. The invention in claim 5 further characterized in that the peak flux density in the air gap at maximum full-power operation of the transducer is in the vicinity of 20,000 gausses.

7. The invention in claim 1 characterized in that the peak flux density in the air gap at maximum full-power operation of the transducer is in the vicinity of 20,000 gausses.

8. In combination in an electromagnetic transducer assembly designed for efficient underwater generation of high-power acoustic energy densities in excess of approximately 25 peak Watts per square inch of radiating surface when operating at a mid-audible frequency located within the approximate range 500 Hz to 2500 Hz under conditions of 100% rho-c loading, a vibratile circular plate having an outer surface adapted for transmitting oscillatory mechanical vibrations into the water when the transducer is immersed therein, said vibratile circular plate also having an inner plane surface, a first magnetic flux conducting structure having a specified thickness defined by two parallel plane surfaces, means for rigidly attaching the first one of said two parallel plane surfaces of said first magnetic flux conducting structure to the said inner plane surface of said vibratile circular plate, a massive inertial cylindrical base member characterized in that it has at least one circular plane surface, and also characterized in that the diameter of said circular plane surface is comparable to the diameter of said vibratile circular plate, a second magnetic flux conducting structure having a specified thickness defined by two parallel plane surfaces, means for rigidly attaching the first one of said two parallel plane surfaces of said second magnetic flux conducting structure to the said plane surface of said massive inertial base member, said second parallel surface of said second magnetic flux conducting structure characterized in that a plurality of pairs of slots are provided into the said second parallel plane surface of said second magnetic flux conducting structure, a plurality of coils wound with insulated electrical conductors and dimensioned to fit with adequate clearance within said plurality of pairs of slots provided into the said second parallel plane surface of said second magnetic flux conducting structure, rigid potting means filling said clearance space between said coils and said slots, a plurality of spring members characterized in that their overall length dimensions are precisely machined to a uniform specified height, first fastening means for attaching one end of said spring members to the peripheral area of said inner plane surface of said vibratile circular plate, second fastening means for attaching the opposite end of said spring members to the peripheral area of said flat plane surface of said massive inertial base member, the uniform specified height of said plurality of spring members and the precise location of the springs on the peripheral flat surfaces of said vibratile circular plate and said inertial base member establish a specified uniform air-gap dimension between said first and said second magnetic flux conducting structure, an open-ended waterproof housing structure for enclosing said electromagnetic transducer assembly, said housing structure having an annular flat surface at its open end, the outside diameter of said annular surface is approximately equal to the diameter of said vibratile plate, a waterproof elastomer cap bonded to said outer surface of said vibratile circular plate, said elastomer cap including a thin circular peripheral skirt portion extending axially and surrounding the outer peripheral edge of said vibratile circular plate, an annular flexible flat gasket having an external diameter equal to the diameter of said vibratile circular plate and an internal diameter approximately equal to the inner diameter of the open end of said housing structure, said flat gasket located between the periphery of the inner plane surface of said vibratile circular plate and the annular flat surface at the open end of said housing structure, sealed insulated terminal means associated with said housing structure for establishing external electrical connection through the transducer housing to said enclosed electromagnetic transducer assembly, electrical connection means from said plurality of coils to said terminal means, and means for generating controlled electromagnetic forces in the magnetic air gap by supplying controlled electrical power to said electrical terminal means.

9. The invention in claim 8 characterized in that said annular flexible gasket is an integral portion of said elastomer cap bonded to the outer surface of said vibratile circular plate.

10. The invention in claim 8 characterized in that said housing structure includes an elastomer covering bonded to its outer surface.

11. The invention in claim 10 further characterized in that said annular flat flexible gasket is an integral portion of said elastomer covering bonded to the outer surface of said housing structure.

12. The invention in claim 10 further characterized in that a plurality of tapered projections are spaced around the circumference of the elastomer covering which is bonded to the outer surface of said housing structure.

13. The invention in claim 8 characterized in that the compliance of said annular gasket is sufficiently high to insure that the resonance frequency of said outer housing structure in combination with the compliance of said annular gasket occurs below the operating frequency of the transducer.

14. The invention in claim 13 further characterized in that said resonance frequency is at least an octave below the operating frequency of the transducer.

15. The invention in claim 1 characterized in that the weight of said massive inertial base member including the magnetic structure attached thereto is greater than three times the weight of said vibratile plate assembly including the magnetic structure attached thereto.

16. The invention in claim 15 further characterized in that the weight of said inertial base member assembly is at least five times the weight of said vibratile plate assembly.

17. The invention in claim 8 characterized in that the weight of said massive inertial base member including the magnetic structure attached thereto is greater than three times the weight of said vibratile plate assembly including the magnetic structure attached thereto.

18. The invention in claim 8 further characterized in that the weight of said inertial base member assembly is at least five times the weight of said vibratile plate assembly.

* * * * *